US008191416B2

(12) United States Patent
Kuchuk et al.

(10) Patent No.: US 8,191,416 B2
(45) Date of Patent: Jun. 5, 2012

(54) INSTRUMENTED FORMATION TESTER FOR INJECTING AND MONITORING OF FLUIDS

(75) Inventors: Fikri Kuchuk, Meudon (FR); Terizhandur S. Ramakrishnan, Boxborough, MA (US); Tarek M. Habashy, Burlington, MA (US); Ian Falconer, Houston, TX (US); Saygi Gokhan, Burlington, MA (US); Edward Harrigan, Richmond, TX (US); Anthony Goodwin, Sugar Land, TX (US); Lawrence Leising, Missouri City, TX (US); Fernando Mattos, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 722 days.

(21) Appl. No.: 12/276,673

(22) Filed: Nov. 24, 2008

(65) Prior Publication Data

US 2010/0126717 A1 May 27, 2010

(51) Int. Cl.
*E21B 47/10* (2012.01)

(52) U.S. Cl. ..... 73/152.41

(58) Field of Classification Search ..... 73/152.05, 73/152.39–152.42; 324/333–343
See application file for complete search history.

(56) References Cited

U.S. PATENT DOCUMENTS 3,116,449 A * 12/1963 Vogel ..... 324/323
3,187,252 A * 6/1965 Hungerford ..... 324/343
3,539,911 A * 11/1970 Hopkinson et al. ..... 324/343
3,562,523 A 2/1971 Richardson et al.
3,748,474 A 7/1973 Murphy
3,808,520 A * 4/1974 Runge ..... 324/343
3,878,890 A 4/1975 Fertl et al.
RE28,963 E 9/1976 Ferti et al.
4,052,893 A 10/1977 Murphy et al.
4,102,396 A 7/1978 Ransom et al.
4,360,777 A * 11/1982 Segesman ..... 324/339
4,420,975 A * 12/1983 Nagel et al. ..... 73/152.41
5,269,180 A 12/1993 Dave et al.
5,323,648 A * 6/1994 Peltier et al. ..... 73/152.17
5,335,542 A 8/1994 Ramakrishnan et al.
5,508,616 A * 4/1996 Sato et al. ..... 324/343
5,644,076 A * 7/1997 Proett et al. ..... 73/152.41
5,796,252 A 8/1998 Kleinberg et al.
5,963,037 A 10/1999 Brady et al.
6,061,634 A 5/2000 Belani et al.
6,441,618 B2 8/2002 Rossi et al.
(Continued)

OTHER PUBLICATIONS

Cassou, G. et al., Movable Oil Saturation Evaluation in an Ultra-Mature Carbonate Environment, Society of Petrophysicists and Well Log Analysts 1st Annual Middle East Regional Symposium, Abu Dhabi, UAE, Apr. 2007, pp. 1-16.

*Primary Examiner* — John Fitzgerald
(74) *Attorney, Agent, or Firm* — David J Smith

(57) ABSTRACT

An example instrumented formation tester for injecting fluids and monitoring of fluids described herein includes a downhole tool which can be deployed in a wellbore via a wireline or a drill string. The downhole tool may facilitate the injection of fluids into an underground formation, and the monitoring of the directions in which the injected fluids flow in the formation in an open hole environment. In particular, the downhole tool may be configured for removing the mud cake from a portion of the wellbore wall for facilitating a fluid communication with the formation to be tested.

22 Claims, 10 Drawing Sheets

U.S. PATENT DOCUMENTS 6,672,386 B2 * 1/2004 Krueger et al. ..... 166/252.5
6,905,797 B2 6/2005 Broman et al.
7,138,803 B2 * 11/2006 Bittar ..... 324/337
7,281,588 B2 10/2007 Shampine et al.
7,656,160 B2 * 2/2010 Legendre et al. ..... 324/339
7,861,801 B2 * 1/2011 Alberty ..... 175/50
7,948,238 B2 * 5/2011 Bittar ..... 324/337
2004/0069487 A1 4/2004 Cook et al.
2004/0238218 A1 * 12/2004 Runia et al. ..... 175/57
2004/0238220 A1 * 12/2004 Meister et al. ..... 175/59
2006/0000606 A1 1/2006 Fields et al.
2007/0261855 A1 11/2007 Brunet et al.
2010/0126717 A1 5/2010 Kuchuk et al.

* cited by examiner

INSTRUMENTED FORMATION TESTER FOR INJECTING AND MONITORING OF FLUIDS

BACKGROUND

This disclosure relates to the evaluation of underground formations penetrated by a wellbore. More particularly, this disclosure relates to methods and apparatuses for facilitating the injection of fluids into an underground formation and for monitoring the directions in which the injected fluids flow within the formation and displace the formation connate fluids.

In the evaluation of reservoirs, it is desirable to understand, measure, and test how fluids move through the formation. A number of methods are currently used to test reservoir fluid mobility and formation permeability and relative permeabilities. Some of these techniques include the measurement of invasion by a drilling fluid. Other techniques are generally known as formation testing and core analysis.

A determination of drilling fluid invasion can be a useful measure indicative of an approximate permeability of the formation. However, this approach may be limited by an insufficient invasion process, in particular due to the creation of a mud cake. Additionally, the permeability measured from invasion is related to the relative permeabilities of the mud filtrate and the connate formation fluid. The permeability measured from invasion may provide little indication of the relative permeability curves when fluids other than the mud filtrate displace the connate formation fluid. Further, it is assumed that the invasion process is uniform around the wellbore and therefore, the permeabilities derived from this analysis do not take into account the formation anisotropy.

Formation testers can determine in-situ reservoir fluid mobility in response to a drawdown, but formation testers typically cannot inject fluids into a reservoir due to the presence of a mud cake. In some cases, pumping fluid from the formation may be sufficient to remove the mud cake. However, in many cases, pumping fluid from the formation may not produce a high enough flow velocity to reliably remove the entirety of the external mud cake from the wellbore wall and the internal mud cake which occupies the pore space just beyond the wellbore wall. During injection, the residual mud cake and mud particles (including drilling fines) may re-seal the wellbore wall and thus may limit or prevent further fluid injection. Thus, in many cases, injecting fluid into the formation may not be possible in an open hole environment. Further, the presence of mud cake, particles and formation damage at the near-wellbore sand face can significantly interfere with the fluid mobility observed by the formation tester. Still further, increasing the flowing pressure induced by the formation tester in such an environment will typically result in a loss of seal of the formation tester against the wellbore wall or may induce a fracture in the formation. If the seal is lost, the formation tester will no longer be in hydraulic communication with the reservoir formation and any measurements will not be representative of the reservoir formation. Once a fracture has been created in the reservoir formation, subsequent mobility or permeability measurements may be dominated by flow into and out of the fracture and thus will not be representative of the reservoir formation.

When analyzing a core for determining formation relative permeabilities, a sample of formation rock is cut, brought to surface and its properties are tested in a laboratory. However, it can sometimes be difficult to recreate in the surface laboratory the representative downhole conditions, such as pressure, temperature and fluid properties.

Systems for injecting fluids into formations do exist today. For example, the mud cake may be dissolved or flushed away with a chemical solvent such as an acid. However, mud cake solvents are typically highly corrosive. These solvents may present a safety hazard to operational personnel and may damage some of the components of a formation tester. Therefore, these injection systems usually require the mud in the wellbore to be replaced with a completion fluid and the mud cake to be dissolved using acids. In some cases, this requires at least a portion of the well to be cased, perforated, and completion equipment such as tubing and packers to be installed before injection can be performed. In these cases, measurements derived from injection in the reservoir formation may come too late to make critical decisions regarding the well completion. Also, the zones which can be injected into may be limited by the locations of the perforations. Further, the presence of casing during the injection may limit the type of downhole measurement tools which can be used to monitor the injection front to those downhole measurement tools that can perform measurements into the formation through a casing (usually metallic, magnetic and conductive) and are suitable to a cased hole environment.

SUMMARY OF THE DISCLOSURE

In accordance with a disclosed example, a method to evaluate an underground formation penetrated by a wellbore involves conveying an elongated tool having a longitudinal axis into the wellbore, the elongated tool having a transmitter coil and a receiver coil, at least one of the transmitter coil and the receiver coil having an axis tilted with respect to the longitudinal axis of the downhole tool. The method also involves injecting a fluid through at least a substantial portion of the perimeter of the wellbore wall and into a portion of the underground formation. The method further involves emitting an electro-magnetic wave into the underground formation using the transmitter coil. A resistivity value of the underground formation is measured using the receiver coil, wherein the resistivity value is indicative of a depth of invasion of the underground formation by the injected fluid, in a direction related to a tilting direction of at least one of the transmitter coil axis and the receiver coil axis.

In accordance with a disclosed example, an apparatus for evaluating an underground formation penetrated by a wellbore includes an elongated tool body having a longitudinal axis adapted for conveyance into the wellbore. The elongated body includes means for injecting a fluid through at least a substantial portion of the perimeter of the wellbore wall and into a portion of the underground formation, a transmitter coil for emitting an electro-magnetic wave into the underground formation, and a receiver coil for measuring a resistivity value of the underground formation. At least one of the receiver coil axis and the transmitter coil axis is tilted with respect to the longitudinal axis of the downhole tool body. The apparatus further includes a processor for determining a depth of invasion of the underground formation by the injected fluid in a direction related to a tilting direction of at least one of the transmitter coil and the receiver coil.

In accordance with a disclosed example, a method to evaluate an underground formation penetrated by a wellbore involves conveying an elongated tool having a longitudinal axis into the wellbore using a coiled tubing, cleaning at least a substantial portion of the perimeter of the wellbore wall using a high velocity fluid jet provided downhole via the coiled tubing, providing an injection fluid downhole through a bore of the coiled tubing, and injecting the fluid through the cleaned portion of the wellbore wall and into a portion of the underground formation. A property of the underground formation indicative of a saturation of the injected fluid in the underground formation is measured.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
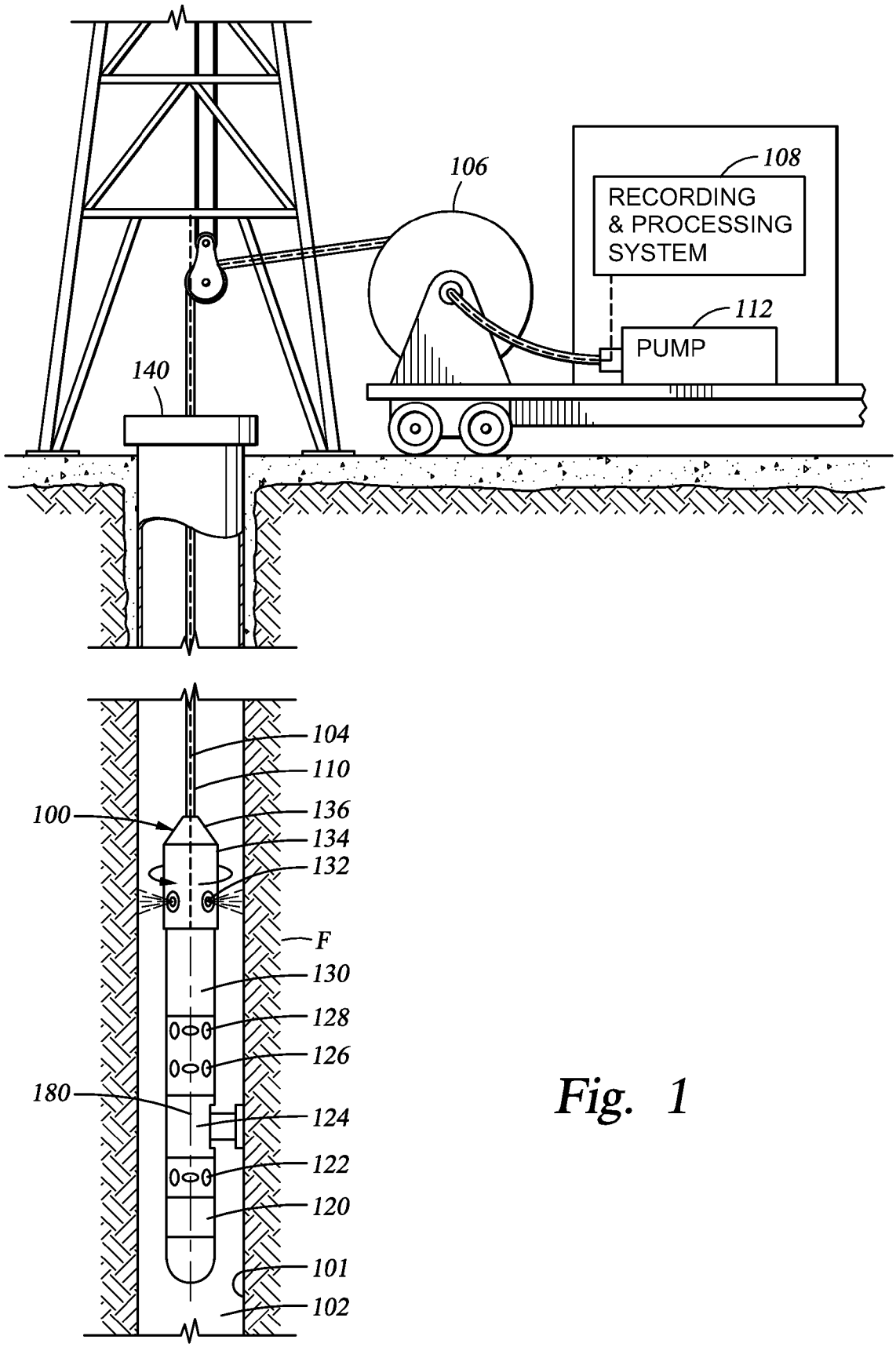
FIG. 1 is an elevation view of an example well site system that may be used for evaluating a depth of invasion in a particular direction of an underground formation by a fluid injected via coiled tubing.

An instrumented formation tester for injecting fluids and monitoring a flow of injected fluids within the formation and/or the displacement the formation connate fluids is described herein. The formation tester comprises a downhole tool which can be deployed in a wellbore via a wireline or a tubing string (e.g., a logging while drilling string, a coiled tubing string, etc). The downhole tool may be used to advantage for the evaluation of underground formations penetrated by a wellbore. The downhole tool and testing methods disclosed herein may facilitate the injection of fluids into an underground formation, and the monitoring of the directions in which the injected fluids flow in the formation in an open hole environment. In particular, the downhole tool may be configured for removing the mud cake from a portion of the wellbore wall for facilitating fluid communication between the formation to be tested and the formation tester. Thus, once the mud cake has been cleared, fluid may be injected with increased uniformity into the formation matrix.

In some embodiments, the mud cake can be removed from the wellbore wall by use of a fluid jet that is forced, for example, through one or more flow lines of the downhole tool. In other embodiments, a modified dual packer module accomplishes a similar result by means of a rotating scraper and flushing mechanism disposed within the dual packer interval. Residual mud and mud cake debris may be removed out of the dual packer interval and into the wellbore through a flow line and a pump. In yet other embodiments, the mud cake is mechanically scraped from the wellbore wall while the well or a packer interval is underbalanced (i.e., its pressure is maintained close to or below the pressure in the formation). Maintaining the testing region underbalanced may prevent or minimize the mud cake from starting to reform after being scraped away. However, the well may alternatively be maintained overbalanced (i.e., its pressure is maintained close to or above a formation pressure) if the scraping is essentially continuous, or when a fluid disposed in the testing portion of the wellbore is formulated to minimize the formation of a mud cake. Thus, a continuous extended invasion process may be created.

Once the mud and mud cake have been adequately removed from the vicinity of the wellbore wall portion adjacent to the formation to be tested, the downhole tool may be used to inject one or more fluids into the formation. More particularly, the downhole tool may be configured to inject a known quantity of fluid(s) at a number of depths at one or more flow rate(s) determined by a surface operator. Properties of the fluid being injected, such as resistivity, flow rate, optical densities, and chemical composition, may be known from analysis prior to conveyance downhole or may also be monitored real-time using sensors in the downhole tool. Alternatively, the injection may be initiated from surface equipment (e.g., a surface pump) instead of the downhole tool.

The injection fluid may be water, steam, hydrocarbon (fluid or gas), some other chemical, or a combination or mixture thereof. The injection fluid may also be mud filtrate, optionally mixed with additives, for example, to improve its detection when injected in the formation. The fluid may be filtered with a 1 to 5 micrometer filter prior to deployment in the downhole tool to remove particles which may otherwise plug the formation pores or the downhole tool hydraulics components (e.g., valves, pump) when injected into the formation. A plurality of injection fluids may be used for testing the same zone with more than one type of fluid (e.g., with water, brine, hydrocarbon, gas or some chemical for stimulating the formation or changing the connate fluid properties such as surfactants, viscosity reducers or diluents). Mixtures of fluids conveyed in different chambers may also be produced downhole and injected into the formation to produce a desired reaction or to perform relative permeability testing. Sequences of injections of different fluids may be performed in order to measure the response of the formation to a particular sequence.

For example, the downhole tool may be configured for carrying one or more chambers containing an injection fluid. A plurality of chambers may be used to advantage for permitting multiple zones to be injected into, or for permitting the same zone to be injected with more than one type of fluid (i.e., different fluids). The downhole tool may be configured to pump fluid into the formation from sample chambers in the downhole tool. The pump may further be configured to reverse the flow direction and to pump fluids from the formation into the downhole tool. In other configurations, the downhole tool may use one pump for injection and a second pump for sampling of fluids from the formation. In some cases, the injection can be accomplished without a pump simply by using the hydrostatic pressure in the wellbore which is typically above the formation pressure. In this case a flow regulation device may be installed to regulate the flow rate and pressure of the fluid being injected.

Alternatively, if a large volume of fluid is required to be injected into the formation, the downhole tool may be deployed on drill pipe or coiled tubing which would facilitate providing downhole fluid volumes greater than can be feasibly transported by a wireline conveyed tool. A large volume of injection fluid may be pumped from surface through the conveyance string. When using this approach, it may be advantageous to ensure that the hydrostatic pressure of the well is controlled so as to minimize the undesirable injection of wellbore mud into the formation as well as to mitigate pressure changes in the well that arise when the injection fluid replaces portions of the mud column. For example, the injection fluid may have a lower density than the mud and the wellbore pressure may be lowered. A downhole wellbore pressure sensor and a surface pack-off valve may be used to control the well hydrostatic pressure during such operations.

The downhole tool also may be provided with sensors integrated into the downhole tool or the dual packer assembly. Example sensors include, but are not limited to, induction coils, laterolog pads, and nuclear magnetic resonance (NMR) probes. These sensors may be configured for monitoring the displacement and the properties of the fluid as it is injected and flows into the formation. For example, these sensors may have radial and azimuthal resolution which allows a determination of the pattern of displacement of the fluid after it has been injected into the formation. By measuring the direction and rate of flow of a known injected fluid into the formation as a function of the injection volume and direction, determinations can be made about the formation anisotropy and permeability properties. For example, injecting known fluids into the formation and observing fluid saturation changes in the formation is useful for the determination of formation properties.

In operations, once a zone of interest has been reached, the formation properties may be evaluated prior to injection using a conventional formation evaluation suite of measurements such as 3-D induction, nuclear and magnetic resonance, sonic and seismic. Then, the downhole tool is positioned in the wellbore and hydraulic communication with the formation is established, for example by inflating dual packers. Subsequently, the mud cake may be removed mechanically or by flushing the wellbore wall with a water jet or by a combination of both.

Sensors may monitor the formation and fluid properties in the formation prior to and during cleanup of mud cake and the invaded zone around the wellbore while pumping out and flushing the mud cake. The sensors may interrogate fluid properties in the formation or in the flow line in the tool immediately after the fluid exits the formation. These measurements collected by the sensors may provide a surface operator real-time information on depth of initial invasion, formation permeability and fluid properties of mud filtrate and connate fluids around the test zone and residual fluid saturations after cleanup.

These sensors may then monitor the formation and fluid properties in the formation as injection proceeds. The measurements collected by the sensors may provide a surface operator real-time information on depth of injection, injection front geometry and rate, initial, intermediate and residual fluid saturations, etc., which can be used to determine important reservoir properties such as relative permeability, anisotropy, and residual oil saturations, amongst others.

A number of different fluids may be injected to determine if the response of the formation properties such as permeability or the fluid mobility changes after exposure to these fluids. Different injection fluids may be used to simulate different enhanced oil recovery (EOR) techniques and thus evaluate which approach is optimal for production of the tested formation. Before, during or after the injection is complete, fluid samples may be taken by reversing the direction of pumping or by using another pump to extract formation fluids into sample chambers, for example using a conventional fluid sampling method. Thus in some cases, a sequence of chemical injection, sampling, injection sampling may be utilized to see if additional hydrocarbon can be extracted using different chemicals and injection fluids.

After the injection and/or fluid sampling is complete, the downhole tool can be retracted and the formation can again be analyzed using conventional formation evaluation tools to determine any changes as a result of the injection and/or sampling operation.

Once a zone of interest has been evaluated, the tool may be deployed to a different depth and the process repeated. This has the advantage of allowing the surface operator to interrogate variations in reservoir properties with depth.

FIG. 1 shows an elevation view of an example well site system that may be used for evaluating a depth of invasion in a particular direction of an underground formation by a fluid injected via coiled tubing. In particular, FIG. 1 describes a downhole tool string 100 conveyed via a coiled tubing 110 in a wellbore 102 penetrating a formation F. The downhole tool string comprises an elongated portion having a longitudinal axis 180, and is adapted for conveyance into the wellbore 102. The coiled tubing 110 is unreeled from a surface drum 106 as well known in the art. The downhole tool string 100 comprises a wellbore wall cleaning tool 134 which may be similar to a Jet Blaster tool (of Schlumberger Technology Corporation) and one or more formation evaluation sensors (e.g., sensors 126, 128, or 124).

To facilitate and/or expedite the injection of a fluid or series of fluids into an open hole formation, the wellbore wall cleaning tool 134 comprises a rotating spray head (e.g., a sleeve having one or more nozzles 132). Fluid pumped down the center of the tubing 110 via a surface pump 112 exits at the rotating spray head and may return to surface via the annulus between the tubing and the formation. The nozzle(s) 132 is(are) configured so that fluid exits the spray head at a high velocity and may break up the mud cake lining a portion of a wellbore wall 101. Uniformly breaking the mud cake along a substantial portion of the perimeter of the wellbore wall may reduce the measurement error arising from the mud cake presence on measurements performed by the downhole tool 100. Indeed, as the mud cake is removed from the wellbore wall 101, the injection flow in the tested region of the formation F is essentially controlled by the matrix properties of the formation (e.g., the formation permeability, the formation anisotropy) and thus may be representative of the reservoir. In contrast, if the mud cake is not removed from the wellbore wall, the injection flow in the tested region of the formation F near the wellbore may depend on the mud cake properties and thus may not be representative of the reservoir behavior.

The wellbore wall cleaning tool 134 is operatively coupled to the coiled tubing 110 via the logging head 136. Further, the wellbore wall cleaning tool 134 may advantageously be configured for supporting formation evaluation tools below it. For example, a spray head of the wellbore wall cleaning tool 134 may include a hollow mandrel (not shown) which can mechanically support the weight of formation evaluation tools below. If required, the coiled tubing 110 may be provided with an internal wireline cable 104 that may be used to provide power to wireline formation evaluation tools. In this case, the hollow mandrel would have a sealed connector at the bottom of the wellbore wall cleaning tool 134 which allows electrical connections of the wireline cable 104 to the wireline formation evaluation tools via an electronics cartridge 130. In addition, the wireline cable 104 may be configured to provide an adequate data telemetry bandwidth between the wireline tools and a surface processing and recording system 108, still via the electronic cartridge 130. However, the wireline cable 104 is not required and the formation evaluation tools may alternatively run on batteries (not shown), acquire formation data, and store the acquired data in a downhole memory (not separately shown), for example conveyed in the electronic cartridge 130.

To determine formation properties, and in particular fluid saturations, before and/or after fluids are injected into the formation, the downhole tool string 100 is provided with formation evaluation sensors configured to provide formation measurements such as any of resistivity lateral logs, induction resistivity logs, NMR logs, nuclear spectroscopy logs or dielectric logs. Shown in FIG. 1 is a tri-axial induction array having tri-axial transmitter coils 122 and tri-axial receiver coils 126 and 128 and an NMR tool 124.

The tri-axial transmitter coils 122 are configured to emit an electro-magnetic wave into the underground formation F. The tri-axial receiver coils 126 and 128 are configured for measuring an induced voltage or current indicative of a resistivity value of the underground formation F. In FIG. 1, two tri-axial receiver coils axially spaced along the axis of the elongated body of the tool string 100 are depicted. However, any number of transmitters and receivers may be provided. In particular, various spacings between receivers and transmitters may be provided for investigating several depths into the formation and more accurately characterizing the distribution of the injected fluid in the formation as a function of the radial distance from the wellbore wall. In particular, the spacings between receivers and transmitters may be determined based on the injection capabilities of the tool string 100 (e.g., injection depth of one meter into the formation). As shown in the example of FIG. 1, the tri-axial transmitter coil 122 and the tri-axial receiver coils 126 and 128 are provided with three orthogonal coils disposed essentially on a plurality of transverse planes of the downhole tool string 100. In particular, each tri-axial coil comprises one coil having an axis aligned with the longitudinal axis 180 of the elongated body of the downhole tool string 100 and two coils tilted with respect to the longitudinal axis 180 of the downhole tool (in this particular example perpendicular to said axis). The frequency at which the transmitter coils are operated may be selected so that the measurement provided by the tilted transmitter coils and/or the tilted receiver coils has an adequate azimuthal response so that resistivity measurements provided by the tri-axial induction array are indicative of a resistivity of the formation and injected fluid in a direction related to a tilting direction of the transmitter coil axis or the receiver coil axis. While FIG. 1 depicts a particular configuration of an induction tool, other configurations may alternatively be used, such as described in *Oilfield Review*, Summer 2008, pp 64-84, or as described in U.S. Pat. No. 5,508,616, amongst other references. U.S. Pat. No. 5,508,616 is incorporated herein by reference.

The NMR tool 124 as depicted in FIG. 1 is of eccentered type. In other words, the volume of the formation investigated by the NMR tool 124 is limited to a particular sector of the wellbore wall. However, a complete image around the wellbore may be achieved by rotating the NMR tool 124 around the wellbore axis, for example by using a powered swivel (not shown) disposed for example in the electronics cartridge 130. In this example implementation, the NMR tool 124 is configured to measure at least one of a diffusion constant distribution D, a longitudinal relaxation time distribution $T_1$, and a transverse relaxation time distribution $T_2$. The measured distributions may be used to derive porosity, permeability, water, oil and gas fractions, or gas-oil ratio (GOR) data, using methods known in the art. These data may be used to select a particular interval of the wellbore 102 to be tested. Alternatively or additionally, these data may be used to determine saturations in the near wellbore before, during or after injection, and may be used for example to calibrate an Archie equation that can consequently be used with the induction measurements provided by the induction coils 122, 126 and/or 128 to determine an injection fluid saturation distribution in the formation F.

To determine a downhole orientation of the coils 122, 126, and 128, or to determine a downhole orientation of the NMR tool 124, the downhole testing string 100 is provided with a general purpose inclinometry tool 120. The tool 120 may include, for example, accelerometers configured to determine the relative orientation of the downhole testing string 100 with respect to the Earth's gravitational field. Further, the tool 120 may include magnetometers configured for determining the relative orientation of the downhole testing string 100 with respect to the Earth's magnetic field.

To maintain wellbore pressure during the injection operation at a desired level, the example well site system of FIG. 1 may be provided with a surface pack-off or other pressure seal 140. For example, the surface pack-off 140 allows maintaining the well pressure above the formation pressure and thus may prevent formation fluid flowing into the well. The surface pack-off 140 may be particularly useful when injection fluids which are less dense than the drilling fluid are used. Optionally, a downhole wellbore pressure sensor may be provided in the tool string 100, for example, as part of the tool 120, to monitor the downhole wellbore pressure as testing proceeds. Data collected by the pressure sensor may be used to control the downhole wellbore pressure using the surface pack-off 140.

In operation, the downhole tool string 100 is conveyed in the wellbore 102 penetrating the formation F using the coiled tubing 110. Formation properties (such as fluid saturations) are evaluated using formation evaluation tools (e.g., the NMR tool 124, or the tri-axial induction tool comprising the transmitter coils 122 and the receiver coils 126, 128). The data collected by the formation evaluation tools may be transmitted to the recording and processing system 108, using the telemetry cartridge 130 and the wireline cable 104. An interval is selected to inject fluids. For example, permeability and oil fraction data measured by the NMR tool 124 may be used to identify a potential producing zone of the formation F.

A viscous gel may be pumped from the surface using the pump 112 into the coiled tubing 110 and delivered to a depth interval of the wellbore 102 via the nozzle 132 of the cleaning tool 134. The viscous gel may fill a portion of the wellbore 102 and displace the initial wellbore fluid (typically drilling mud) away from the injection interval, thus isolating an interval of the wellbore from wellbore fluids. Next, the injection fluid is pumped at the desired depth interval using the pump 112. The injection fluid is pumped with sufficiently high velocity to penetrate mud cake and any layer of damaged permeability immediately behind the mud cake. The downhole pressure is regulated at the pack-off valve 140 to be higher than the formation pressure so that the injected fluid differentially flows into the formation F. While the same fluid may be used to clean the wellbore wall in a portion of the isolated interval and to perform an injection through a substantial portion of the perimeter of the wellbore wall and into the formation, it may be desirable to perform the above with two distinct fluids. The pumped fluid may initially be a cleaning fluid which has properties desirable for penetrating the mud cake and damaged zone. For example, the cleaning may contain abrasives or other additives for this purpose. During this step, the wellbore pressure is preferably maintained below the formation pressure at the testing depth. The injection fluid may then be delivered downhole. The injection fluids may have different properties than the cleaning fluid. For example, the injection fluids may comprise a sequence of fluids designed to simulate an enhanced oil recovery (EOR) treatment. In particular, the injection fluid may comprise water to sweep hydrocarbons to a residual oil level and simulate a water flood, a polymer designed to plug fractures or other large permeability features and force subsequent injection fluids into unplugged space of the tested portion of the formation, a surfactant or other EOR fluid bank designed to change the miscibility or mobility of the residual oil, or water to drive the surfactant bank. The injected fluids may be doped with tracers to assist with detection by the formation evaluation sensors conveyed in the downhole tool string 100. Those skilled in the art will appreciate that there are many combinations of injection fluids which may be considered and within the scope of the present disclosure.

Figure 2:
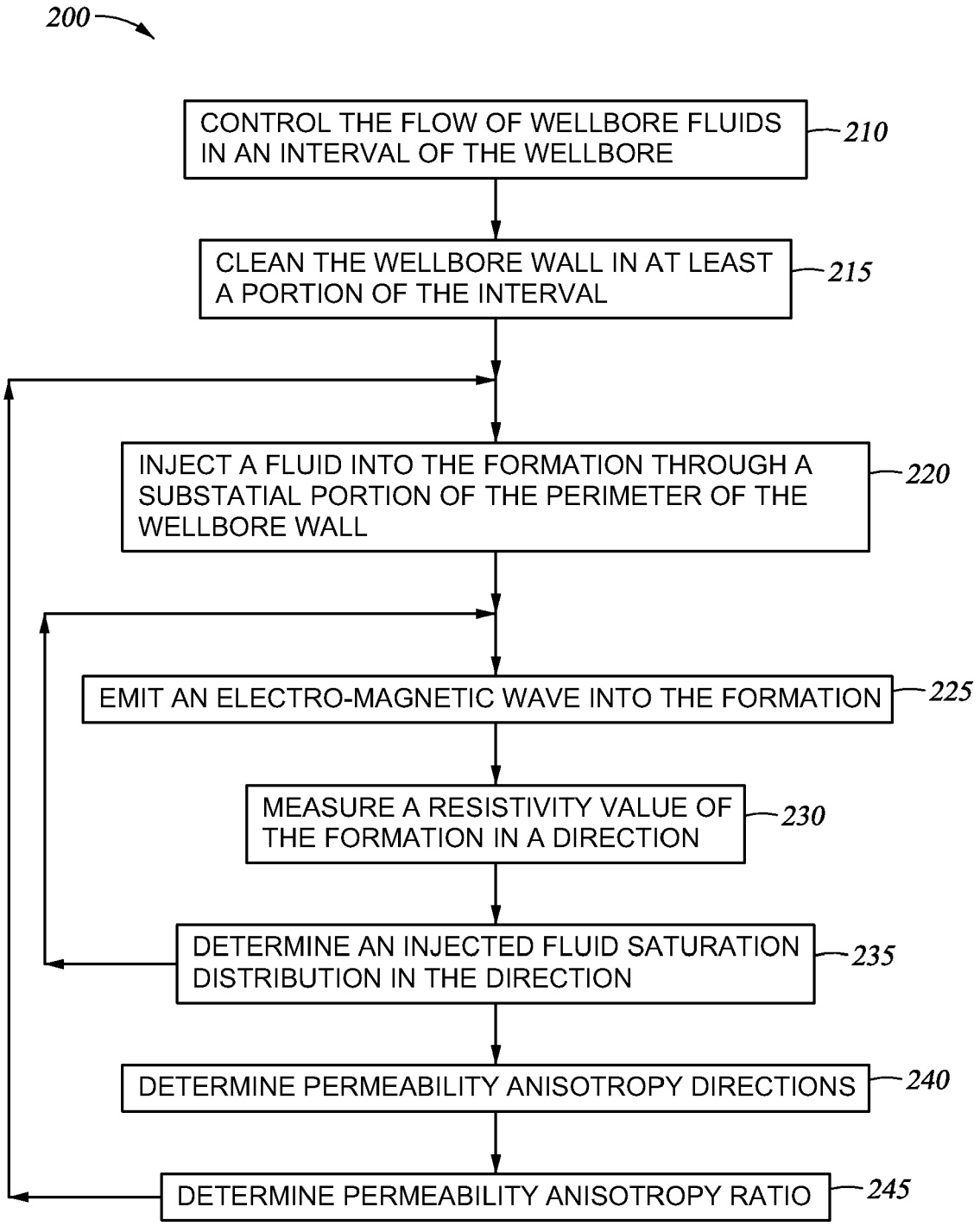
FIG. 2 is a flow diagram of an example method that may be used for evaluating a depth of invasion of an underground formation by an injected fluid.
Figure 3A:
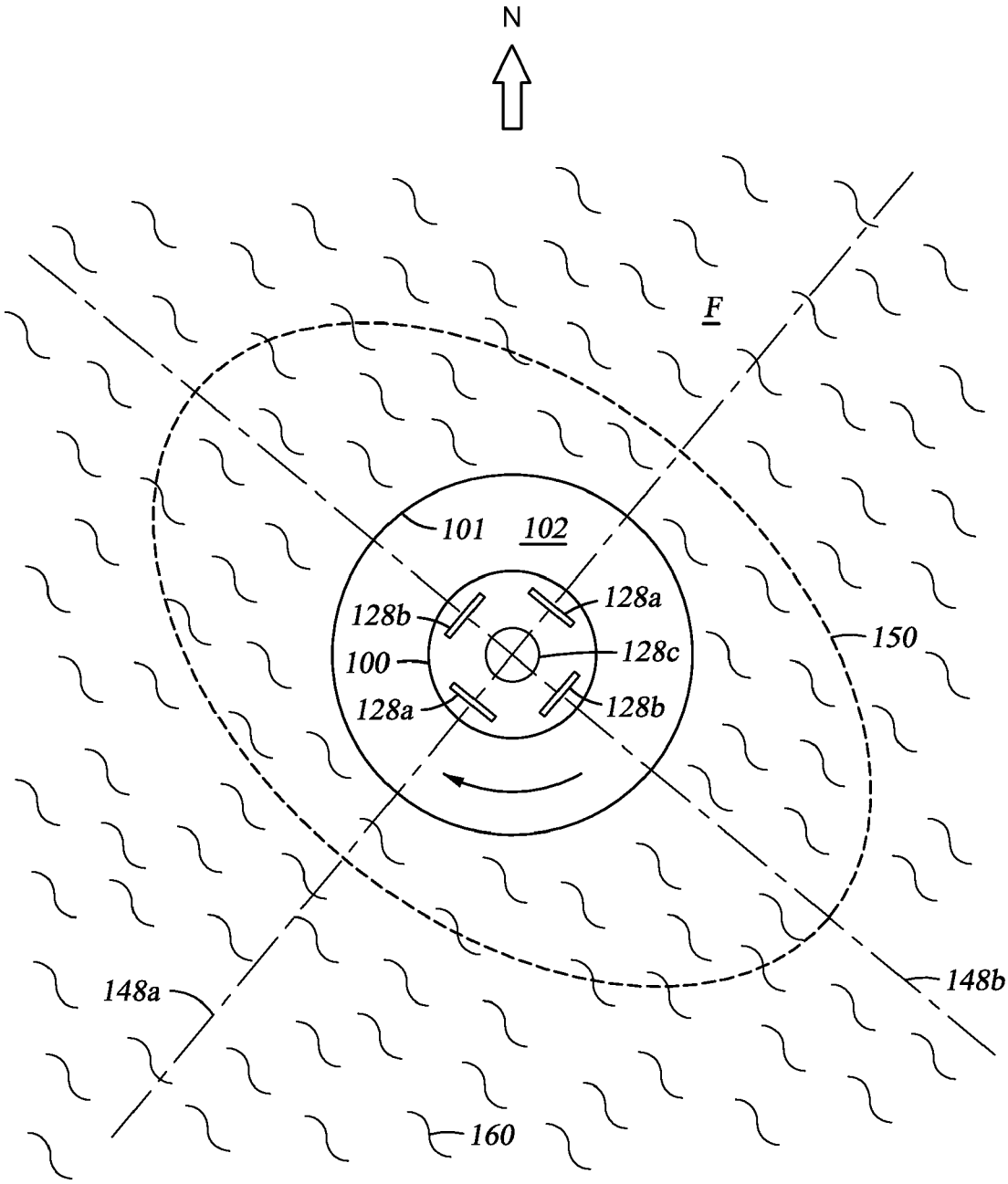
FIG. 3A is a horizontal cross section view of the well shown in FIG. 1 depicting an anisotropic injection zone having an non circular injection front, and a coil arrangement configured for measuring a resistivity value of the underground formation, the resistivity value being indicative of a depth of invasion of the underground formation in a direction related to the coil configuration.
Figure 3B:
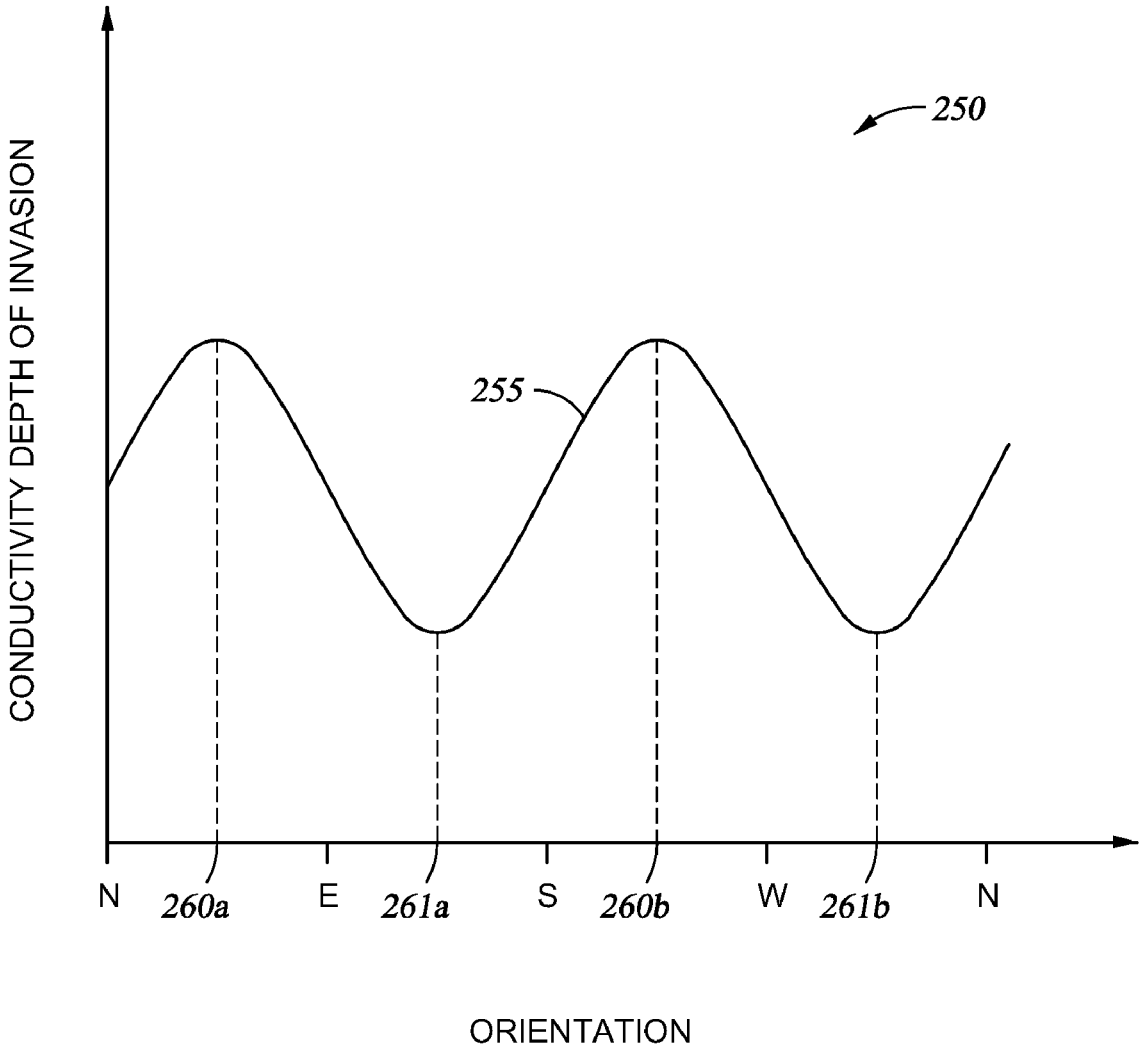
FIG. 3B is an example graph of a measured resistivity value as a function of a direction related to a coil orientation.

After injection, the tool string 100 can be moved to position the formation evaluation sensors (e.g., the coils 122, 126, and 128 or the NMR tool 124) adjacent or otherwise proximate the injection interval to determine the change in formation properties and fluid saturations as a result of the fluid injection, as further described, for example, in FIGS. 2, 3A and 3B. It may be desirable to repeat the formation evaluation measurements after each injection step to determine the effectiveness and injection sweep or locus of each injection fluid in the formation F. After all injections have been performed and measurements made, the tool can be moved to another testing depth or retrieved to the Earth surface. Before the tools are retrieved, it may be advantageous to circulate wellbore fluids in order to restore the original state of the well pressure.

While FIG. 1 describes a tool string 100 having a combination of the fluid injector tool 134 and the formation evaluation tools or sensors, it is possible to perform a similar operation with multiple tool strings and/or multiple runs in the same wellbore. In this case, multiple trips in the well would have to be performed with the formation evaluation tools or sensors before and after injections. Preferably, the well pressure should be controlled after pumping each fluid in the wellbore and before deploying the formation evaluation tools or sensors.

FIG. 2 depicts a flow diagram of an example method 200 that may be used for evaluating a depth of invasion of an underground formation by an injected fluid. The method 200 may be implemented using downhole tools including, but not limited to, the downhole tools described herein.

At block 210, the flow of wellbore fluids in an interval of the wellbore is controlled. The interval includes the portion of the wellbore wall that will be injected through. The operations of block 210 may be useful to prevent undesired invasion of the tested portion of the formation by wellbore fluids. These wellbore fluids may carry particles that may clog the formation when the wellbore fluid seeps into the formation, potentially leading to greater uncertainty in the measurements performed on the formation.

Figure 6:
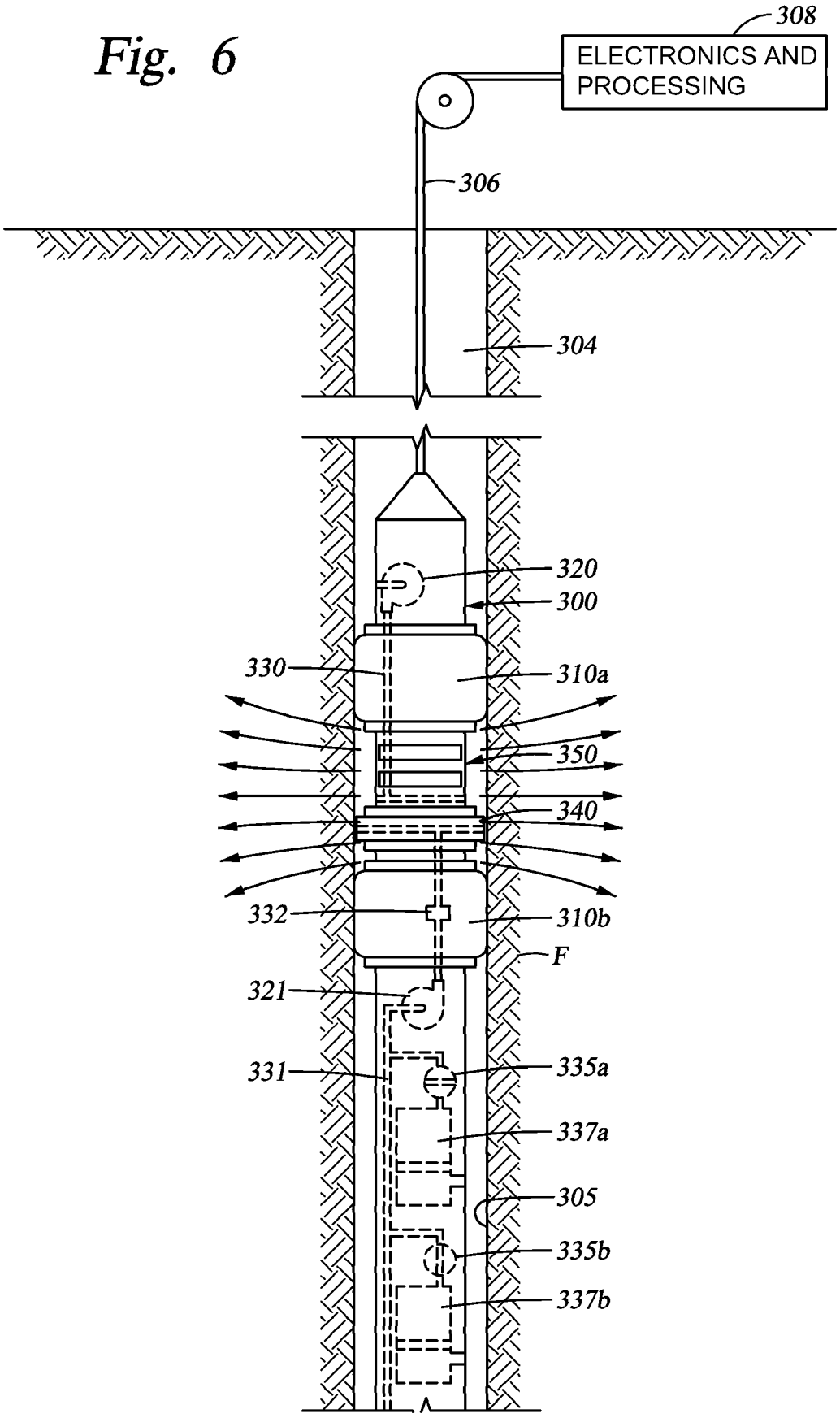
FIG. 6 is an elevation view of yet another example well site system having a wellbore cleaning device that may be used for injecting a fluid through at least a substantial portion of the perimeter of the wellbore wall, and a sensor assembly that may be used for evaluating a depth of invasion in a particular direction of an underground formation by an injected fluid.
Figure 8:
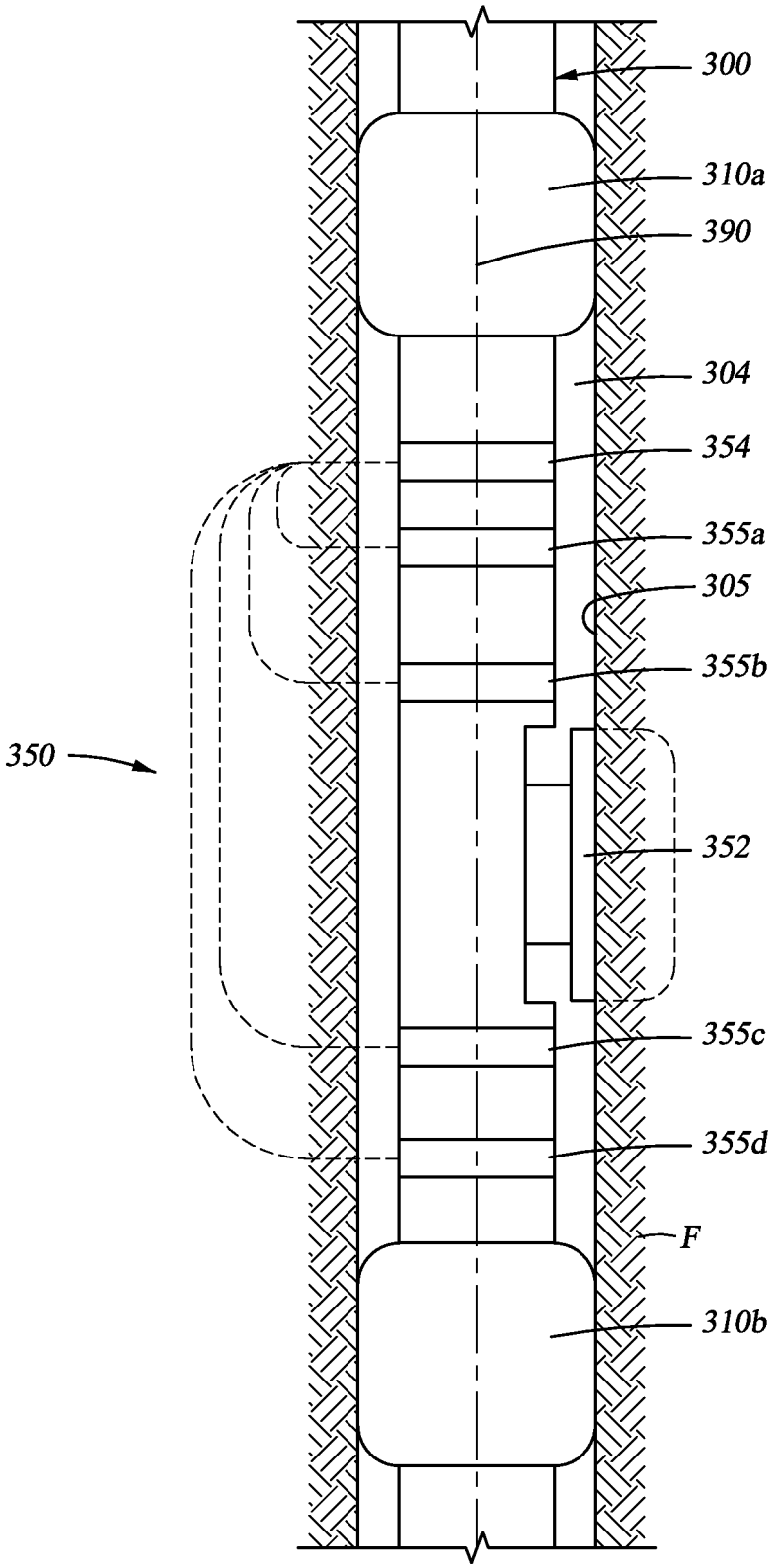
FIG. 8 is an elevation view of an example implementation of the sensor assembly shown in FIG. 6.

For example, the flow of wellbore fluid is controlled by isolating an interval of the wellbore from the wellbore fluid. In this case, the block 210 may be implemented by inflating dual packers (as illustrated in FIGS. 6 and 8), or by disposing a viscous gel in the wellbore near the interval (as described in relation to FIG. 1). In another example, the flow of wellbore fluids may be minimized by using a surface valve (e.g., the pack-off valve 140 of FIG. 1) and by reducing the wellbore pressure to a similar or lower level than the formation pressure at that depth.

At block 215, at least a portion of the interval is cleaned. More particularly, a mud cake, as well as a damaged zone in the near wellbore may be removed for establishing a fluid communication between the wellbore and the formation. The operations of block 215 may be useful for facilitating the injection of fluid through a substantial portion of the perimeter of the wellbore wall. Further, the operations at block 215 may insure that the injection pattern (e.g., the flow rate distribution around the wellbore) is representative of the formation (e.g., the formation heterogeneity, the formation anisotropy) and is not or little affected by the mud cake or the near wellbore damage. By doing so, a more accurate characterization of the formation may be achieved. Those skilled in the art will appreciate that the operations of block 215 may conversely be useful for facilitating the sampling of formation fluid, for example by reducing the pressure drop across the formation wall as fluid is sampled. This may be useful for sampling fluids in single phase, and in particular for sample retrograde condensate gas or other critical formation fluids.

Figure 4:
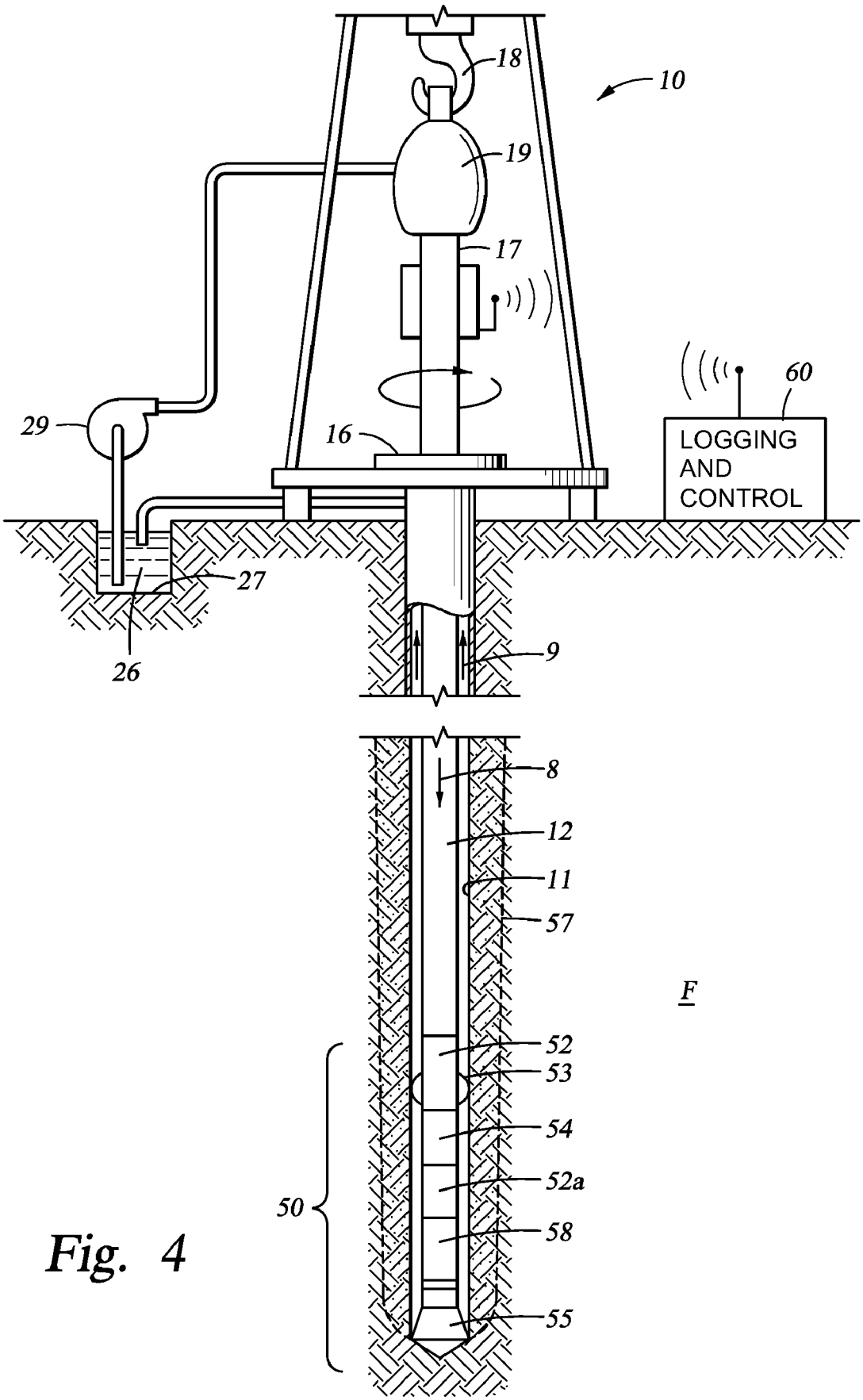
FIG. 4 is an elevation view of another example well site system having a resistivity tool that may be used for evaluating a depth of invasion of an underground formation by a drilling fluid.

For example, the wellbore wall may be cleaned using a high velocity jet (as provided by the wellbore wall cleaning tool 134 of FIG. 1), or by mechanically scraping the mud cake and/or the formation damaged zone (as illustrated in FIGS. 4 and 6). Optionally, a pump, such as a downhole pump, may be used to evacuate the debris generated during the wellbore cleaning out of the tested region. Other examples of devices that may be used for cleaning a wellbore wall may be found in U.S. Patent Application Pub. No. 2007/0261855, incorporated herein by reference.

At block 220, a fluid is injected into the formation through a substantial portion of the perimeter of the wellbore wall. The operations at block 220 may be adapted for insuring that a relatively large and representative volume of the formation (e.g., 1 meter into the formation) about the wellbore is investigated. A large investigated volume may be useful to determine characteristics of an underground reservoir. In contrast to extendable probe systems, the apparatus of the present disclosure may allow to test highly heterogeneous formations, such as those formations having a network of fractures, as is sometimes encountered in carbonate reservoirs.

For example, the injected fluid may be forced into the formation using a surface pump (see e.g., FIG. 1), a downhole pump (see e.g., FIG. 6), or the wellbore hydrostatic pressure (see e.g., FIG. 4). Flow control devices may be used to monitor the pressure during injection and to insure that the formation is not fractured, however flow control devices can also be used to ensure a fracture is generated by the injection. The volume and flow rate of injected fluid is preferably measured for consequent analysis.

At block 225, an electro-magnetic wave is emitted into the formation. Preferably, the electro-magnetic wave has a frequency content adapted to penetrate into the formation beyond the invasion front created by the invasion of the injected fluid. Optionally, the electro-magnetic wave may be generated in a non uniform manner around the wellbore. Such electro-magnetic waves may be useful for measuring a resistivity value of the formation indicative of a depth of invasion of the formation by the injected fluid in a particular azimuthal direction around the wellbore. Thus, the permeability anisotropy of the formation in the cross sectional plane of the wellbore may be determined. This information may be useful, for example, to design an injection well for an underground formation. In particular, this information may be useful to predict breakthrough of injected fluid into a producing well.

For example, the electro-magnetic-wave may be generated by a transmitter coil disposed on a downhole tool body and driven by an alternating current. The transmitter coil axis may be tilted with respect to the longitudinal axis (e.g., the axis 180 of FIG. 1) of the downhole tool body, however the transmitter coil axis may be aligned with the longitudinal axis of the downhole tool and a receiver coil axis may be tilted to achieve similar results.

At block 230, a measurement of a resistivity value of the formation relatively more sensitive to a particular direction or to a particular section of the formation is performed. The resistivity value may be indicative of the efficiency of the injection in the particular direction. In contrast to the measurements of the prior art that are essentially sensitive to the average resistivity of the formation around the wellbore, the resistivity value measured at step 230 may be used to quantify the formation anisotropy along sectional planes of the wellbore.

For example, the resistivity measurement may be performed by measuring an induced voltage or current at a receiver coil disposed on the body of the downhole tool and spaced apart therefrom. The receiver coil axis may or may not be tilted with respect to the longitudinal axis of the downhole tool, as discussed above. The direction may be monitored downhole using the general purpose inclinometry tool 120.

At block 235, a saturation distribution of the injected fluid in the said direction may be computed. In this case, it is assumed that the injected fluid and the connate formation fluid have a resistivity contrast. This may be achieved by injecting saline water in oil or gas formation, or oil in water formations. A depth of invasion by the injected fluid in the said direction may also be determined from the saturation distribution, for example, based on a cut-off value of the injected fluid saturation levels determined previously.

For example, the depth of invasion may be determined by inverting a model of the formation having an invasion front at a particular distance from the wellbore and separating a high resistivity zone and a low resistivity zone. The model may be inverted from resistivity values obtained with sensors having different depths of investigations into the formation (e.g., the pair of transmitter coil 122 and receiver coil 126, and the pair of transmitter coil 122 and receiver coil 128, all illustrated in FIG. 1).

The operations of steps 225, 230 and 235 may be repeated for different directions around the wellbore, and at block 240 the permeability anisotropy directions are determined. The permeability anisotropy directions may be indicated by maxima and minima of the measured values at block 230 of the formation resistivity curve obtained for the different directions around the wellbore, as described for example, in FIGS. 3A and 3B. Alternatively, the permeability anisotropy directions may be indicated by maxima and minima of the computed values at block 235 of an injection invasion depth curve obtained for the different directions around the wellbore.

In some examples, the downhole tool may be rotated to align the tilting direction of one of a receiver coil axis and a transmitter coil axis in another direction. In other examples, the downhole tool is provided with coils having different tilting directions (e.g., the tri-axial coils 122, 126 and 128 in FIG. 1). In these cases, the transmitter coils may be sequentially fired and the response at the corresponding receiver coils may be monitored.

At block 235, permeability ratios may be determined. A transverse permeability ratio may be computed from the permeability of the formation estimated from the injection front profile determined at block 240. In some cases, the injection front profile may not exhibit minima and maxima, and thus transverse anisotropy. However, the formation may still exhibit vertical anisotropy. In these cases, a vertical permeability ratio may still be determined from the horizontal and vertical resistivities determined (e.g., using a forward model inversion technique) from the resistivity values (e.g., a resistivity tensor) measured at block 230.

The operations of steps 220, 225, 230, 235, 240 and 245 may be repeated, for example using a different injection fluid (i.e., an injection fluid having different properties), or the same properties. The measurements obtained for two or more iterations may thus be compared to better determine the formation response, for example to EOR treatments.

FIG. 3A shows a horizontal cross section view of the well 102 depicting an anisotropic injection zone having an non circular injection front 150 and a coil arrangement 128*a* and 128*b*, configured to measure a resistivity value of the underground formation F, the resistivity value being indicative of a depth of invasion of the underground formation in directions related to the coil configuration. In this example, the formation F has a network of micro-fractures 160, shown aligned along a north-east, south-west general direction. This network of micro-fractures may be responsible for permeability anisotropy of the formation F. The permeability anisotropy may be detected using the apparatus and methods of the present disclosure by injecting a fluid through a substantial portion of the perimeter of the wellbore wall 101 and measuring resistivity values of the formation using transmitter coils (e.g., the tri-axial transmitter coil 122 of FIG. 1) and receiver coils, such as the tri-axial receiver coils 128*a*, 128*b* and 128*c* disposed on the body of the downhole tool string 100.

In the example shown, the receiver coils 128*a* are perpendicular to the longitudinal axis of the body of the downhole tool string 100. The axis of the receiver coils 128*a* is aligned with the direction 148*a*. As an electro-magnetic wave is emitted by a corresponding coil of the transmitter 122 (FIG. 1), the current or voltage induced in the coils 128*a* is sensitive to current lines in the formation flowing in a plane perpendicular to the direction 148*a*. Similarly, the receiver coils 128*b* are perpendicular to the longitudinal axis of the body of the downhole tool string 100. The axis of the receiver coils 128*b* is aligned with the direction 148*b*. The current or voltage induced in the coils 128*b* is sensitive to current lines in the formation flowing in a plane perpendicular to the direction 148*b*. Thus, the current or voltage induced in each of the coil 128*a* and 128*b* is sensitive to the resistivity of the investigated formation in a particular plane. In case the formation resistivity is altered by the presence of an injected fluid, the current or voltage induced in each of the coil 128*a* and 128*b* is consequently sensitive to the depth of invasion by the injected fluid. Therefore, a non-uniform depth (as depicted, for example, in FIG. 3A by the invasion front 150) may be detected for a plurality of resistivity measurements corresponding to different tilting directions of the receiver coils 128*a* and 128*b*.

As mentioned before, a plurality of resistivities may be measured with a plurality of tilted coils such as 128*a* and 128*b*. Alternatively or additionally, the downhole tool string 100 may be rotated in the wellbore 102 as indicated by the arrow and until a given tilted coil (e.g., the tilted coil 128*a*) is oriented in a different direction and the resistivity measurement is repeated. Each time a resistivity measurement is performed, the actual orientation of the transmitter and/or receiver coil may be measured using the general purpose inclinometry tool 120. Further, various spacing between transmitter and receiver may be used to investigate the formation resistivity at a plurality of radial distances away from the wellbore wall. The plurality of measurements and their associated direction may be inverted as known in the art to determine a shape of the invasion front 150.

FIG. 3B is an example graph 250 of a measured conductivity curve 255 that is a function of a coil orientation that may be used to determine the preferential directions of flow of an injected fluid. In the example shown, it is assumed the injected fluid has a higher conductivity than the connate formation fluid. In this case, the inverted depth of invasion computed by inversion would exhibit a similar profile as the conductivity curve.

If the formation has transverse anisotropy, the conductivity curve exhibits maxima associated to some particular orientations 260*a*, and 260*b*, as well as minima associated to other particular orientations 261*a* and 261*b*. The orientations associated to the minima and maxima of the curve 255 are indicative of the anisotropy directions of the formation F.

FIG. 4 illustrates a well site system in which one or more aspects of the present disclosure can be employed. The well site can be onshore or offshore. In this exemplary system, a wellbore 11 is formed in subsurface formations by rotary drilling in a manner that is well known. Embodiments of the present disclosure can also use directional drilling, as will be described hereinafter.

A drill string 12 is suspended within the wellbore 11 and has a bottom hole assembly 50 which includes a drill bit 55 at its lower end. The surface system includes platform and derrick assembly 10 positioned over the wellbore 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from the hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 55, and then circulates upwardly through the annulus region between the outside of the drill string and the wall of the wellbore, as indicated by the directional arrows 9. In this well known manner, the drilling fluid lubricates the drill bit 55 and carries formation cuttings up to the surface as it is returned to the pit 27 for recirculation.

The bottom hole assembly 50 of the illustrated embodiment a logging-while-drilling (LWD) module 52, a measuring-while-drilling (MWD) module 54, a rotary-steerable system and motor 58, and drill bit 55.

The LWD module 52 is housed in a special type of drill collar, as is known in the art, and can contain one or a plurality of known types of logging tools. It will also be understood that more than one LWD and/or MWD module can be employed, e.g., as represented at 52*a*. (References, throughout, to a module at the position 52 can alternatively mean a module at the position 52*a* as well.) The LWD module includes capabilities for measuring, processing, and storing information, as well as for communicating with the surface equipment. In the present embodiment, the LWD module includes a directional resistivity measuring device.

The MWD module 54 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid. Other sources of power including battery systems may additionally or alternatively be employed. In the present embodiment, the MWD module 54 includes one or more of the following types of measuring devices: a weight-on-bit measuring device, a torque measuring device, a vibration measuring device, a shock measuring device, a stick slip measuring device, a direction measuring device, an inclination measuring device, and an annular pressure measuring device.

Figure 5:
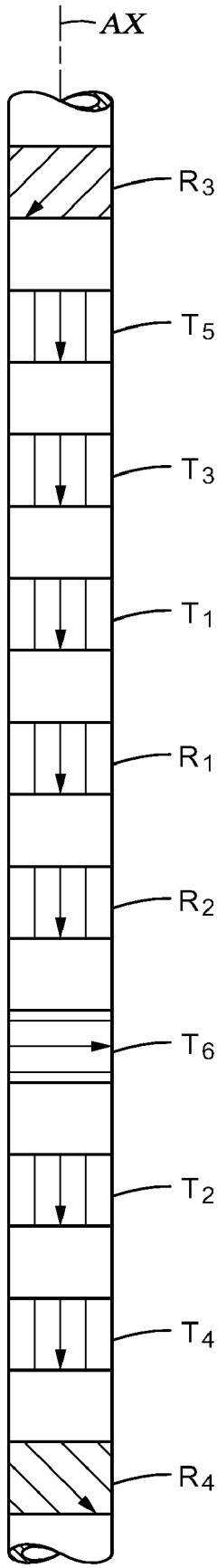
FIG. 5 is an elevation view of an example implementation of the resistivity tool shown in FIG. 4 depicting a coil arrangement configured for measuring a resistivity value of the underground formation, the resistivity value being indicative of a depth of invasion of the underground formation in a direction related to the coil configuration.

FIG. 5 depicts a directional deep-reading logging-while-drilling tool, as part of the LWD tool or tools 52 in FIG. 4. The downhole tool of FIG. 5 provides tilted and transverse coils to obtain directionally sensitive measurements, signals from tools having axially aligned cylindrically symmetrical coils are not directionally sensitive. The sensor array includes six transmitter antennas and four receiver antennas. Five transmitter antennas (T1 through T5) are arranged axially along the length of the downhole tool. A sixth transmitter antenna (T6) is oriented transverse (i.e., tilted 90 degrees) to the downhole tool longitudinal axis AX. A receiver antenna is positioned at each end of the downhole tool. This pair of receiver antennas (R3 and R4) brackets the transmitters, and each of these receivers is tilted 45 degrees to the downhole tool longitudinal axis AX. An additional pair of receiver antennas (R1 and R2), located in the center of the transmitter array, is arranged axially and can obtain conventional type propagation resistivity measurements. The described arrangement produces a preferential sensitivity to conductivity on one side of the downhole tool. As the downhole tool rotates, its sensors can detect nearby conductive zones and register the direction from which maximum conductivity can be measured. Magnetometers and accelerometers can provide reference directional orientation data for the downhole tool. In addition to its directional capability, the downhole tool provides relatively deeper measurements than most conventional LWD resistivity tools. The substantially real time bidirectional drill string telemetry hereof, in conjunction with the capabilities of the directional resistivity logging tool, as described, improves performance of geosteering by increasing the amount of data at the surface and the speed and precision of directional drilling control.

Turning back to FIG. 4, as the drill bit 55 penetrates the formation F, mud may filtrate from the wellbore 11 may be injected into the formation F as the wellbore pressure is typically above the formation pressure, generating an invaded zone 57. Additionally, the newly formed mud cake may be mechanically scraped by a reamer 53, disposed close to the LWD tool 52. In some cases, the invaded zone 57 may present a cross section having an invasion front similar to the invasion front 150 of FIG. 3A. The transmitter antenna T6, or alternatively the transmitter antennae T1 to T5 may be used for emitting an electro-magnetic wave into the underground formation. Further, measurement obtained by the receiver antennae R3 and R4, or alternatively antennae R1 and R2 may be used to measure resistivity values of the formation that are indicative of a depth of invasion of the underground formation by the injected mud. In particular, the measured resistivity values of the formation are preferably selectively sensitive in a direction related to the tilting direction of at least one of the axis of the transmitter antenna T6, and the axis of the receiver antennae R3 or R4. As drilling proceeds, the BHA 50 rotates, permitting to acquire a plurality of resistivity measurements associated with turning axis directions of the tilted transmitter or receiver antennae. These resistivity values may be processed as shown in FIG. 3B to indicate the directions of permeability anisotropy, and/or a permeability anisotropy ratio. When using the apparatus of FIG. 4, it is important to use a mud system that produces a filtrate having resistivity properties different from the resistivity properties of the connate formation fluid (e.g., use water based mud in a hydrocarbon formation).

Thus, the apparatus of FIG. 4 provides a way to generate a large volume of injection fluid (i.e., mud filtrate) by continuously cleaning the wellbore wall using the drill bit 55 and/or the reamer 53. In this case, the formation F is used as the filter to separate the clogging particles of the mud. The bit 55 and/or the reamer 53 act as a wiper to remove mud cake from the wellbore wall and facilitate further invasion.

FIG. 6 is an elevation view of yet another example well site system having a wellbore rotating cleaning device 340 that may be used to inject a fluid through at least a substantial portion of the perimeter of the wellbore wall 305 and a sensor assembly 350 that may be used for evaluating a depth of invasion or penetration of an injected fluid as a function of direction in an underground formation. The well site system comprises a downhole tool 300 lowered in a wellbore 304 via a wireline cable 306 that provides electrical power to the downhole tool 300. In addition, the wireline cable 306 provides a data communication link between the downhole tool 300 and electronics and processing unit 308 located at the Earth's surface. The data communication link may be used to display the information collected by the sensor assembly 350 to a surface operator, store formation evaluation data in a memory device (not shown) and/or deliver a log report. Further, the data communication link may be used for actuating downhole components, such as pumps (e.g., pumps 320 and/or 321), and/or valves (e.g., valves 335*a* and/or 335*b*). Still further, the data communication link may be used to monitor the operations of the downhole tool 300, for example, based on various sensors (e.g., fluid analyzer 332) located on the tool flow lines (e.g., flow lines 330 and/or 331). Optionally, the tool 300 may be conveyed on pipe or coiled tubing (as in FIG. 1 or 4), and fluid pumped into the pipe from the surface may be routed to flow line 321 and injected into the sealed interval.

To control the flow of wellbore fluids in an interval of the wellbore, the downhole tool 300 is provided with an upper inflatable packer 310*a* and a lower inflatable packer 310*b* that can be extended into sealing engagement with the wall 305 of the wellbore 304. The lower and upper inflatable packers 310*a* and 310*b* may be used to fluidly isolate a substantial portion of the perimeter of the wellbore wall 305 from the rest of the wellbore fluid present in the wellbore 304. Thus, as testing of the formation F proceeds, the wellbore fluid may be prevented to flow into the sealed interval and alter the permeability of the formation F in the vicinity of the sealed interval. Further, the lower and upper inflatable packers 310*a* and 310*b* may be used to maintain a pressure in the sealed interval at a desired level, that may be near or below the formation pressure during a phase in which the sealed interval is cleaned, or that may be above the formation pressure during an injection phase of the test.

To remove mud or cleaning debris from the packer interval and/or control the pressure in the packer interval, the downhole tool 300 may be provided with a flow line 330, fluidly connected to the packer interval and to a pump 320. Thus, removed mud cake and excess mud may be pumped out of the interval into the wellbore outside of the packer interval.

To deliver injection and/or cleaning fluids to the packer interval, the downhole tool 300 may be provided with a flow line 331, fluidly connected to the packer interval and to a pump 321. The flow line 331 is further fluidly connected a plurality of sample chambers 337*a* and 337*b*, containing, for example, fluids to be injected. Each sample chamber 337*a* and 337*b* may be selectively connected to the flow line 331 using valves 335*a* and 335*b* respectively. Also, the flow line 331 may be used to extract fluids from the formation F by reversing the flow direction of the pump 321. The samples may optionally be stored in one of the plurality of sample chambers 337*a*, 337*b*. The sample chambers should be designed for carrying sufficiently large volumes to inject in the formation F, subject to the operational weight and length limitations. In some cases, the injection can be accomplished without a pump simply by using a piston which is connected on one side to the injection fluid and the other side is connected to the hydrostatic pressure in the wellbore, which is typically above the formation pressure. Once the mud and mud cake have been removed from the wellbore wall, the sample chamber containing the injection fluid (e.g., sample chambers 337*a*, 337*b*) is connected to an outlet and the hydrostatic pressure pushes a sample chamber piston causing the injection fluid to be at hydrostatic pressure. In this case, a flow regulation device, such as a choke or a throttle valve, may be used to regulate the flow rate and pressure of the fluid being injected.

To measure the properties of the fluid flowing in the flow line 331, the downhole tool 300 may be provided with a fluid analyzer 332. The fluid analyzer 332 may be configured to measure one or more properties of the flowing fluid that include, but are not limited to, flowing pressure, flow rate, viscosity, density, resistivity, temperature, radioactivity and chemical composition. The data collected by the fluid analyzer may be used to determine formation pressure, and fluid fractions such as gas-water, gas-oil, oil-water and different hydrocarbon group fractions. Further, the data collected by the fluid analyzer may be used together with fluid saturations in the formation F measured for example with the sensor assembly 350. Indeed, using Darcy's equation and measured saturations in the formation, it is possible to determine effective and relative permeability distributions by methods that are known in the art. Still further, the response of the formation fluid to the injected fluid, for example, the variation in viscosity with added diluents, may be required for heavy oil production. These formation evaluation tests will yield information required in determining from the plethora of plausible production processes the most suitable method for the formation F. Example implementations of the fluid analyzer 332 include one or more of a density-viscosity sensor based on resonance analysis of a vibrating member, a resistivity sensor, an optical fluid spectrometer, and NMR fluid spectrometer, etc.

To clean the wellbore wall in the packer interval, the downhole tool is provided with the rotating cleaning device 340. The rotating cleaning device 340 establishes a fluid communication between the wellbore and the formation F prior to injection by using a high velocity jet and/or by mechanically scraping the mud cake and/or the formation damaged zone as further described in FIGS. 7A and 7B. Cleaning fluid (e.g., the fluid transported in the sample chamber 337*a*) is pumped through the rotating cleaning device 340 and flushes the mud cake debris out of the packer interval though the flow line 330 and the pump 320.

To perform measurements on the portion of the formation F in communication with the packer interval before, during or after injection, the downhole tool is provided with the sensor assembly 350. In particular, the sensor assembly is configured to measure resistivity values of the formation indicative of the invasion of the injected fluid in particular directions around the wellbore, as further described in FIG. 8.

In operation, a zone of the formation F for which testing is of interest may be identified, for example, by using open hole logs. The downhole tool 300 may then be located in the wellbore 304 so that the packers 310*a* and 310*b* straddle the identified portion of the formation F. Then, the packers may be inflated, thereby isolating the zone of interest of the formation F. If desired, the sensor assembly 350 may be used to perform additional measurements on the formation F.

A portion of the wellbore wall 305 may then be cleaned using the rotating cleaning device 340, and the pump 320. Cleaning the wellbore wall 305 may assist in removing mud from the annulus between the downhole tool 300 and the wellbore wall 305, removing mud cake from the wellbore wall 305, removing a damaged zone in the near-wellbore region having an altered permeability, or removing mud filtrate from the formation in the tested zone. Once a section of the wellbore wall has been cleaned, the pump 320 may be stopped and injection fluid (e.g., the fluid transported in the sample chamber 337*b*) may be pumped into the interval using the pump 321 and forced into the formation by differential pressure, as indicated by the arrows.

During or after cleanup, injection and or sampling, measurements may be performed by the fluid analyzer 332 and the sensor assembly 350 to determine the formation response to changing fluid properties, the chemistry of sampled or injected fluids, and injected or connate fluid saturation levels in the formation. This information may be used to determine relative permeability end points (residual oil saturation and irreducible water saturation). Further, relative permeability curves may be calculated by dynamically measuring injection flow rate, pressure, injection fluid properties and formation fluid saturations.

The fluids to be injected may be selected based on several objectives. The injected fluid should have preferably sufficient mobility to be injected into the formation without plugging the pores in the formation, so it may be filtered at the surface or downhole so as to not plug the hydraulic components of the tool 300 and/or the pores of the formation F. The fluid may also provide a contrast with the formation connate fluid or with the invaded filtrate in the formation so that its saturation level or distribution in the formation F may be measured with the sensor assembly 350. Examples of fluids providing a contrast include, but are not limited to fluids providing a resistivity contrast. For example, a conductive fluid may be injected into a formation region containing non-conductive fluid or vice versa. Examples of fluids providing a contrast further include fluids providing a phase contrast. For example, water may be injected into a hydrocarbon-bearing formation or vice versa.

The injected fluids may contain additives that provide an easily identifiable signature on the measurements performed by the sensor assembly 350. For example $MnCl_2$ doped water has little response to NMR measurements in contrast to clear water.

Additional examples of fluids that may advantageously be injected include fluids which change the mobility of hydrocarbons such as surfactants, solvents or viscosity reduction diluents (carbon dioxide, heated fluid which reduces oil viscosity), etc. Examples of viscosity reductions injection fluid may be found in U.S. Patent Application Pub. No. 2008/0066904, incorporated herein by reference. For example in heavy oil reservoirs, a plurality of diluents may be injected and their effect on the reservoir oil mobility may be compared, for selecting a particular diluent to be used in a VAPEX production process.

Yet additional examples of fluids that may advantageously be injected include drilling fluids. Drilling fluids are generally not well suited to injection because they have a high solid content and, by design, form a mud cake. However, the downhole tool 300 may be configured to filter, segregate or centrifuge drilling fluids downhole to produce a relatively clean injection fluid that may then be injected. For example, filtration could be performed by using a downhole centrifuge or by screens with wipers to remove solid. Thus, the drilling fluid column in the wellbore 304 would become a useful source of a large volume of injection fluid.

As the testing operations are finished, the packers 310*a* and 310*b* of the downhole tool 300 may be retracted and the downhole tool 300 may be moved to the next station. In some examples, fluid sampled at one station may be injected at another station.

Figure 7A:
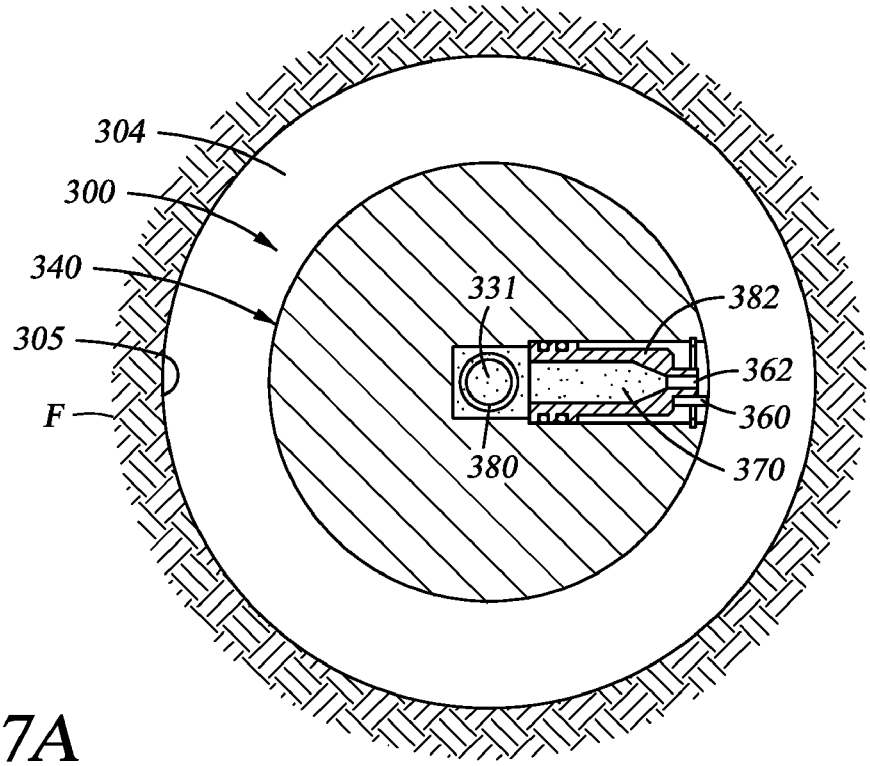
FIGS. 7A and 7B are horizontal cross section views of an example implementation of the wellbore cleaning device shown in FIG. 6.
Figure 7B:
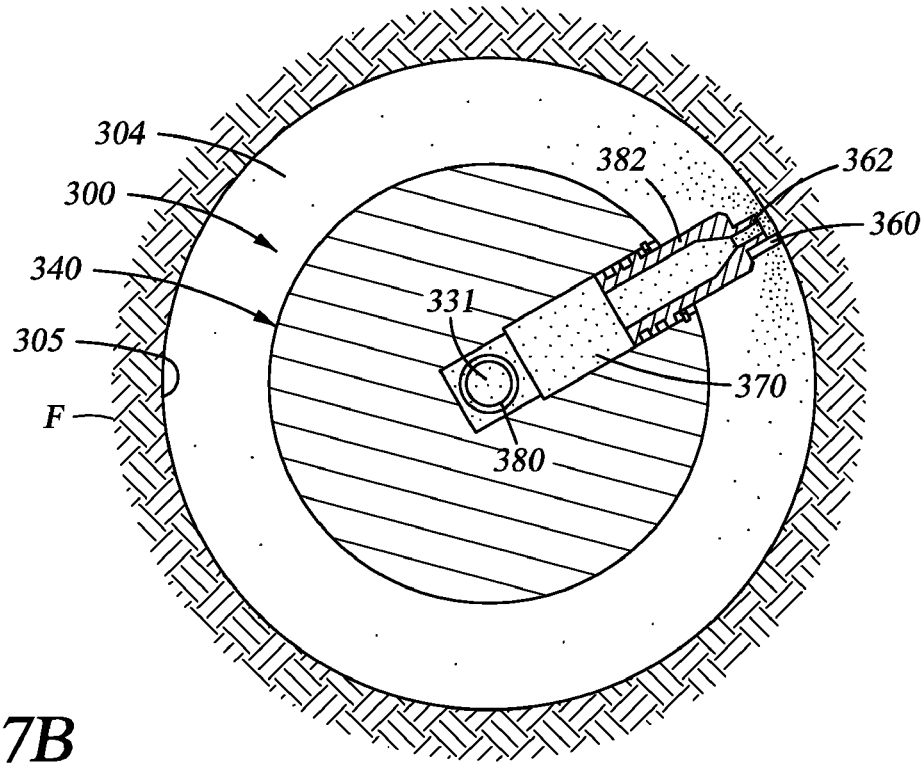

FIGS. 7A and 7B are horizontal cross section views of an example implementation of the rotating cleaning device 340 shown in FIG. 6. In particular, the interval between the packers 310*a* and 310*b* is modified to include an extendable piston 382 which retracts below the outside diameter of the downhole tool 300 (as shown in FIG. 7A) and which extends through the wellbore 304 and into abutment with the wellbore wall 305 (as shown in FIG. 7B). While a single piston 382 is depicted in FIGS. 7A and 7B for clarity, two pistons or more pistons may also be used, as shown for example in FIG. 6.

The position (retracted or extended) of the piston 382 responds to the pressure of the cleaning fluid 370 that is pumped by the pump 321 (in FIG. 6) through the flow line 331. For example, the piston 382 may be configured to be in a retracted position when the pump 321 is turned off, and to be in an extended position when pressure is applied by the pump 321 to the cleaning fluid 370 in the flow line 331. Additionally, the cleaning fluid acts on a turbine and rotary seal 380 which causes the cleaning device 340 and thus the piston 382 to rotate, cleaning thereby a substantial portion of the perimeter of the wellbore wall 305.

The extendable piston 382 is provided with a nozzle 362 configured to provide a high velocity fluid jet. A distal end of the piston 382 may further be provided with a scraper 360. As the cleaning fluid 370 is pumped into the cleaning device 340, the high velocity jet flushes the mud cake away from the wellbore wall 305, and the scraper 360 mechanically removes the mud cake and the damaged zone from the wellbore wall 305.

FIG. 8 is an elevation view of an example implementation of the sensor assembly 350 shown in FIG. 6. The sensor assembly 350 is disposed between the inflatable packers 310*a* and 310*b*.

The sensor assembly includes a tri-axial induction array comprising a tri-axial transmitter coil 354 and a plurality of tri-axial receiver coils 355*a*, 355*b*, 355*c* and 355*d* for investigating the formation F with increasing radial distance away from the wellbore wall 305. In the tri-axial transmitter coil 354 and the tri-axial receiver coils 355*a*, 355*b*, 355*c* and 355*d*, two of the coils are tilted with respect to (and in particular perpendicular to) the longitudinal axis 390 of the body of the tool 300. While pumping fluid from or into the formation F, resistivity measurements are made at different depths in the formation. The resistivity measurements may be used together with pumping pressures, pumping rates or other data collected by the downhole tool 300 in inversion algorithms which determine formation fluid saturation distributions (3-D distributions), formation porosity and permeability anisotropy. For example, a 3-D image of saturations can be produced from the resistivity measurements performed by the tri-axial induction array. The 3-D image of saturation may be performed before, during or after pumping fluids into or out of the formation, thus the change in fluid saturations can be monitored in real time at surface. Successive 3-D images of saturation may be used to determine permeability anisotropy, as well as permeability distributions in the formation. Real time information at surface can be used by the surface operator to determine when enough pumping has been performed to achieve a representative result.

It may be useful to permit axial and angular movement of the tri-axial induction array shown in FIG. 8 to acquire data corresponding to various depth or orientation of the array. This may be achieved by deflating the packers 310*a* and 310*b* for moving the tool 300, or as further detailed below.

The sensor assembly 350 also comprises an articulated extendable probe 352 which houses an NMR measurement pad, deployed against the wellbore wall to perform magnetic resonance measurements on the fluid in the pore space of the formation F. While pumping fluid from or into the formation, several measurements may be performed and analyzed to determine formation porosity, permeability and fluid saturations.

The extendable probe 352 may have the ability to rotate and translate within the packer interval. For example, the packers may be attached to a sleeve slidably coupled to the body of the downhole tool 300, for example as shown in U.S. Patent Application Pub. No. 2008/0066535, incorporated herein by reference. The downhole tool 300 may then be moved longitudinally (or rotated azimuthally) and provide measurements corresponding to multiple axial locations (or orientations) of the extendable probe 352 within the interval packer and without requiring the packers to be deflated or retracted. Optionally the extendable probe 352 may incorporate a cutter or scraper mechanism configured to remove the mud cake and cut away the damaged zone from the wellbore wall. Thus the extendable probe may be used to clean a suitable portion of the wellbore wall to insure proper injection into the formation F within the measurement locus.

Alternatively, the extendable probe 352 may contain sensors which perform a measurement of dielectric constant (or complex electric permittivity) to obtain fluid saturation and matrix texture measurements, a pulsed neutron generator and gamma ray detectors to measure porosity and fluid saturation measurements, a resistivity measurement device such as a local laterolog, micro-laterolog, micro-spherically focused log (MSFL) or micro-cylindrically-focused log (MCFL), or local electromagnetic propagation or induction measurements to measure high resolution formation resistance, or acoustic measurements for imaging acoustic characteristics. These alternative sensors may be useful for imaging porosity, structure, heterogeneities, and fractures in the formation around the packer interval, for example while flowing an injection fluid. Further the extendable probe 352 may contain an array of such sensors to produce a wellbore wall image in the packer interval.

Figure 9:
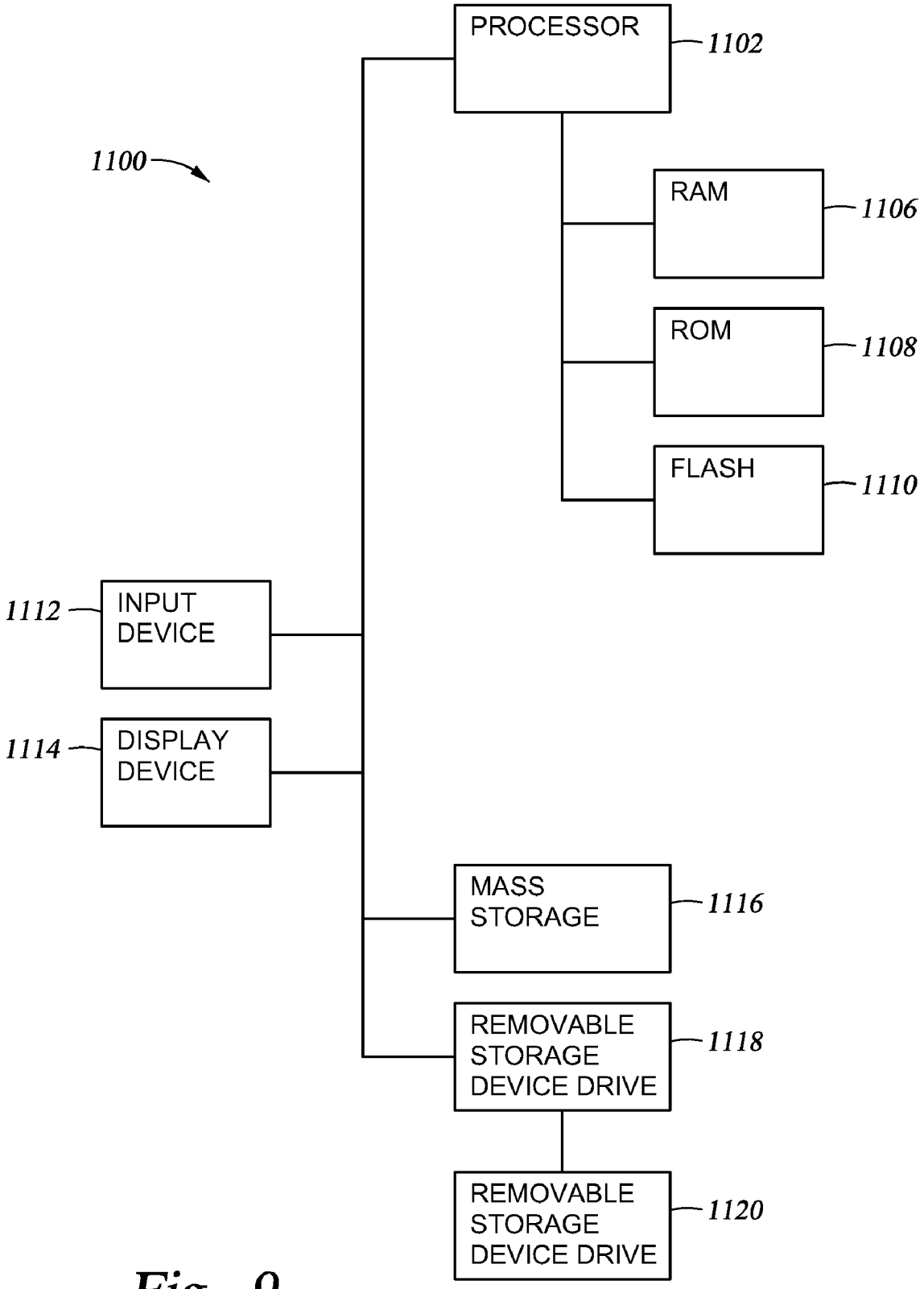
FIG. 9 is a block diagram of an example processing unit that may be used to implement one or more aspects of the example methods and apparatus described herein.

FIG. 9 is a block diagram of an example computing system 1100 that may be used to implement the example methods and apparatus described herein. For example, the computing system 1100 may be used to determine a depth of invasion of the underground formation by an injected fluid from downhole sensor measurements.

Further the computing system 1100 may be used to implement the above-described recording and processing system 108 of FIG. 1, the logging and control system 60 of FIG. 4 and/or the electronics and processing system 308 of FIG. 6. Alternatively, portions of the computing system 1100 may be used to implement downhole components such as the above-described the electronics cartridge 130 of FIG. 1 and the processing system of the tools 52 or 52A of FIG. 4. The example computing system 1100 may be, for example, a conventional desktop personal computer, a notebook computer, a workstation or any other computing device. A processor 1102 may be any type of processing unit, such as a microprocessor from the Intel® Pentium® family of microprocessors, the Intel® Itanium® family of microprocessors, and/or the Intel XScale® family of processors. Memories 1106, 1108 and 1110 that are coupled to the processor 1102 may be any suitable memory devices and may be sized to fit the storage demands of the system 1100. In particular, the flash memory 1110 may be a non-volatile memory that is accessed and erased on a block-by-block basis. As described before, the processor 1102, and the memories 1106, 1108 and 1110 may additionally or alternatively be implemented downhole, for example, to store, analyze, process, and/or compress test and measurement data (or any other data) acquired by the downhole tool sensors.

An input device 1112 may be implemented using a keyboard, a mouse, a touch screen, a track pad or any other device that enables a user to provide information to the processor 1102.

A display device 1114 may be, for example, a liquid crystal display (LCD) monitor, a cathode ray tube (CRT) monitor or any other suitable device that acts as an interface between the processor 1102 and a user. The display device 1114 as pictured in FIG. 11 includes any additional hardware required to interface a display screen to the processor 1102.

A mass storage device 1116 may be, for example, a conventional hard drive or any other magnetic or optical media that is readable by the processor 1102.

A removable storage device drive 1118 may, for example, be an optical drive, such as a compact disk-recordable (CD-R) drive, a compact disk-rewritable (CD-RW) drive, a digital versatile disk (DVD) drive or any other optical drive. It may alternatively be, for example, a magnetic media drive. A removable storage media 1120 is complimentary to the removable storage device drive 1118, inasmuch as the media 1120 is selected to operate with the drive 1118. For example, if the removable storage device drive 1118 is an optical drive, the removable storage media 1120 may be a CD-R disk, a CD-RW disk, a DVD disk or any other suitable optical disk. On the other hand, if the removable storage device drive 1118 is a magnetic media device, the removable storage media 1120 may be, for example, a diskette or any other suitable magnetic storage media.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method for evaluating an underground formation penetrated by a wellbore, comprising:

conveying an elongated tool having a longitudinal axis into the wellbore, the elongated tool having a transmitter coil and a receiver coil, at least one of the transmitter coil and the receiver coil having an axis tilted with respect to the longitudinal axis of the tool;

injecting a fluid through at least a portion of the wellbore wall and into a portion of the underground formation;

emitting an electro-magnetic wave into the underground formation using the transmitter coil; and measuring a resistivity value of the underground formation using the receiver coil, the resistivity value being indicative of a depth of invasion of the underground formation by the injected fluid, in a direction related to a tilting direction of at least one of the transmitter coil axis and the receiver coil axis.

2. A method as defined in claim 1 further comprising determining a depth of saturation of the injected fluid in the direction related to a tilting direction of at least one of the transmitter coil and the receiver coil based on at least the measured resistivity value.

3. A method as defined in claim 2 further comprising determining the depth of invasion of the underground formation by the injected fluid in the direction related to a tilting direction of at least one of the transmitter coil and the receiver coil based on a depth of saturation of the injected fluid.

4. A method as defined in claim 1 further comprising cleaning a substantial portion of the perimeter of the wellbore wall prior to injecting the fluid into the portion of the underground formation.

5. A method as defined in claim 4 further comprising providing a cleaning fluid in the wellbore prior to cleaning the wellbore wall.

6. A method as defined in claim 4 further comprising reducing a wellbore pressure below the formation pressure for facilitating the cleaning of the wellbore wall.

7. A method as defined in claim 6 further comprising sealing off a portion of the wellbore between two packers and reducing the wellbore pressure between the packers.

8. A method as defined in claim 1 further comprising measuring a plurality of resistivity values of the underground formation.

9. A method as defined in claim 8 wherein at least two of the plurality of resistivity values correspond to at least two different tilting directions of at least one of the transmitter coil and the receiver coil.

10. A method as defined in claim 8 wherein a plurality of receiver coils having different tilting directions are conveyed on the elongated tool body and wherein at least two of the plurality of resistivity values are measured with one or more receiver coils having different tilting directions.

11. A method as defined in claim 8 wherein a plurality of transmitter coils having different tilting directions are conveyed on the elongated tool body and wherein at least two of the plurality of resistivity values are measured with one or more transmitter coil having different tilting directions.

12. A method as defined in claim 1, wherein conveying an elongated tool having a longitudinal axis into the wellbore is performed using one of a drill pipe and a coiled tubing.

13. An apparatus for evaluating an underground formation penetrated by a wellbore, comprising:

an elongated tool body having a longitudinal axis adapted for conveyance into the wellbore, the elongated body comprising:

means for injecting a fluid through at least a portion of the wellbore wall and into a portion of the underground formation, a transmitter coil for emitting an electro-magnetic wave into the underground formation, and a receiver coil for measuring a resistivity value of the underground formation, wherein at least one of the receiver coil axis and the transmitter coil axis is tilted with respect to the longitudinal axis of the downhole tool body; and a processor for determining a depth of invasion of the underground formation by the injected fluid in a direction related to a tilting direction of at least one of the transmitter coil and the receiver coil.

14. An apparatus as defined in claim 13 further comprising at least one of a magnetometer and an accelerometer for determining an orientation of the downhole tool body in the wellbore.

15. An apparatus as defined in claim 13 further comprising a plurality of transmitter coils, the transmitter coils being tilted with respect to the longitudinal axis of the downhole tool body in different directions.

16. An apparatus as defined in claim 13 further comprising a plurality of receiver coils being tilted with respect to the longitudinal axis of the downhole tool body in different directions.

17. An apparatus as defined in claim 13 further comprising a rotary table for orienting at least one of the transmitter and the receiver coils.

18. An apparatus as defined in claim 13 further comprising a scraper for removing a mud cake lining the wellbore.

19. An apparatus as defined in claim 13 further comprising a packer for isolating a portion of the well adjacent to an injection port.

20. An apparatus as defined in claim 13 wherein the means for injecting a fluid delivers a viscous gel injected in the wellbore to isolate an interval of the wellbore.

21. An apparatus as defined in claim 13 further comprising a fluid jet for removing a mud cake lining the wellbore.

22. An apparatus as defined in claim 21 further comprising a tubing string for conveying the tool body into the well, the tubing string having an internal flow passageway in selective fluid communication with the jet.

* * * * *